United States Patent [19]

Roux

[11] Patent Number: 4,530,616

[45] Date of Patent: Jul. 23, 1985

[54] MEANS FOR ASSEMBLING TUBULAR SCAFFOLDING ELEMENTS

[76] Inventor: Marcel H. R. Roux, Saint Martin de Brethencourt, 78660 Ablis (Yvelines), France

[21] Appl. No.: 585,434

[22] Filed: Mar. 2, 1984

Related U.S. Application Data

[62] Division of Ser. No. 327,694, Dec. 4, 1981.

[30] Foreign Application Priority Data

Dec. 4, 1980 [FR] France ..... 80 25734
Oct. 27, 1981 [FR] France ..... 81 20117

[51] Int. Cl.[3] ..... F16B 9/02
[52] U.S. Cl. ..... 403/246; 403/49
[58] Field of Search ..... 403/49, 189, 190, 246

[56] References Cited

U.S. PATENT DOCUMENTS 4,044,523 8/1977 Layher ..... 403/49 X

FOREIGN PATENT DOCUMENTS 7701060 8/1978 Netherlands ..... 403/49

*Primary Examiner*—Andrew V. Kundrat
*Attorney, Agent, or Firm*—Rodgers & Rodgers

[57] ABSTRACT

Means for assembling tubular scaffolding elements comprising an annulus (31) having radial arms (33) and being fixed on a vertical tubular element (32), a bracket or cap (34) engaged on a radial arm and locked by means of a key (35). Annulus (31) is shaped like a star and each radial arm (33) comprises a V-shaped radial clearance (36) and bosses (37,38,39), the sides of which are designed as steps to support the front end of the bracket or cap and are joined to the corresponding radial tubular element (42). The support steps are provided on the upper and lower sides (43,44) of each arm and are of a width and thickness to provide substantial seating to the end of the bracket and directional stability to the radial tubular element both in a vertical and a horizontal plane during the assembly keying operation.

10 Claims, 6 Drawing Figures

MEANS FOR ASSEMBLING TUBULAR SCAFFOLDING ELEMENTS

This is a division of application Ser. No. 327,694 filed Dec. 4, 1981.

The present invention concerns a direction-controlled assembly means especially for tubular scaffolding elements. More particularly a device is provided to rigidly connect in a given direction such horizontal elements as crossbars, longitudinal bars, rails and traverses to vertical elements such as posts and uprights.

In the art of tubular scaffolding, numerous types of assemblies are known which use connections by means of wedges or keys joined to the ends of horizontal elements and which are engaged in radial housings of sleeves joined to corresponding vertical elements. These connections, although providing rigid assemblies do not guarantee directional stability to the horizontal elements with respect to the vertical elements and, therefore, present significant shortcomings wherein the horizontal elements must be absolutely perpendicular to the vertical elements in the vertical plane as well as in the horizontal plane. More recent assemblies are known which have, instead of sleeves, circular disks joined to the vertical elements and which are provided with radial apertures into which split caps joined to the ends of the horizontal elements are locked by means of pins. These pins force the free ends of the caps to rest on the outside walls of the vertical elements. In this assembly means the horizontal elements are clearly perpendicular with respect to the vertical elements, but the radial directional stability of the horizontal elements in the horizontal plane is not assured because of the merely tangential support of the ends of the caps on the outside walls of the vertical elements. Therefore these various assembly means having drawbacks similar to those of prior assembly means especially during the assembly of a tubular construction.

As a consequence, the direction-controlled assembly means of this invention eliminates the above cited drawbacks of the known assembly means by providing specific directional stability to the horizontal elements with respect to the vertical elements and inversely both in the horizontal and the vertical planes. This directional stability is achieved from the beginning of the assembly operation without requiring a check of the mutual orthogonality of the elements at the junctions or an adjustment of the orientation of these elements during the assembly procedure before they are finally locked into place. In addition, this invention allows the assembly of rails, beams and all horizontal tranverses by laterally slipping their ends onto brackets mounted on the uprights.

According to this invention, assembly means between the vertical and horizontal elements of a tubular construction comprises an annulus fixed on a vertical tubular element and having several radial arms each designed to engage a bracket or cap joined to the end of a corresponding radial tubular element and locked onto the arm by a key. The annulus is shaped like a star and each arm thereof constitutes a radial arm having a V-shaped radial clearance and lateral bosses to these clearances. The bosses act as steps to support the front end of the bracket or cap engaged on the arm and joined to the corresponding radial tubular element. The support steps are further provided on the upper and lower sides of each arm and are of an adequate width and thickness to provide substantial seating to the end of the bracket and directional stability to the radial tubular element both in a vertical and a horizontal plane during the assembly operation.

More specifically the annulus is fixed to the vertical tubular element at several radial points in the sections between the radial clearances of the arms. Furthermore, each arm is provided on its lower side with a single stepped boss whereas its upper side comprises two consecutive bosses in the form of steps which permit some play of the radial tubular element in the vertical plane when being engaged. This causes the automatic tipping into the engaged position of the captive key borne by the bracket or cap. In this regard, each bracket comprises two L-shaped elements locked together at the edges of their small sides, the edges of the large sides being adapted to the shape of the corresponding annulus steps so as to rest on them in a stable manner. Also, in each bracket, one of the L-shaped elements comprises a clearance to receive a flat keying means. The clearance is closed on its four sides, whereas in the other element, the corresponding clearance issues into the small side to allow introduction of the slightly bulging tip of the key and to render it captive when the bracket formed by these two elements is fixed during manufacture to the end of the radial tubular element. Also the bracket element comprises an inside cavity corresponding to the bulge of the tip of the captive key. This allows the key to be retracted when the bracket engages an arm of the annulus.

Other features of this invention will become apparent in conjunction with the following description of the various embodiments of the direction-controlled assembly means shown in illustrative manner in the attached drawings in which FIG. 1 is an elevational view of the assembly annulus;

Figure 1:
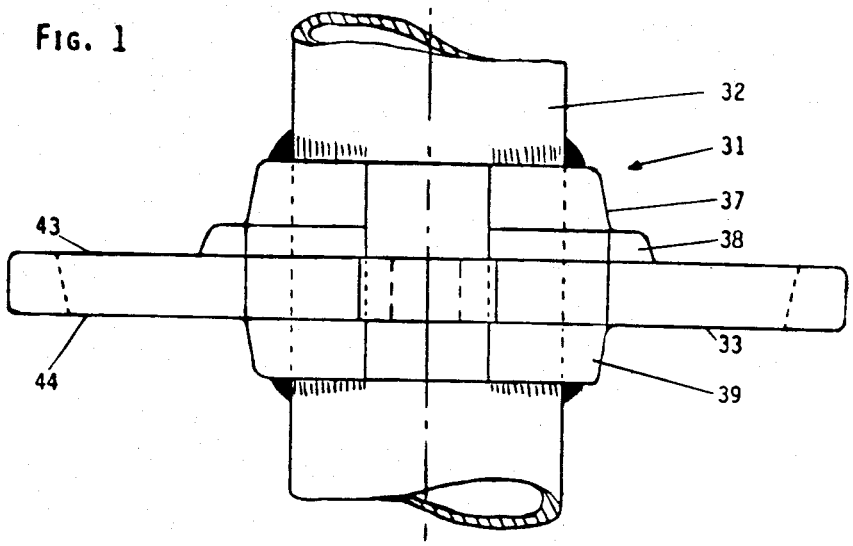
Figure 2:
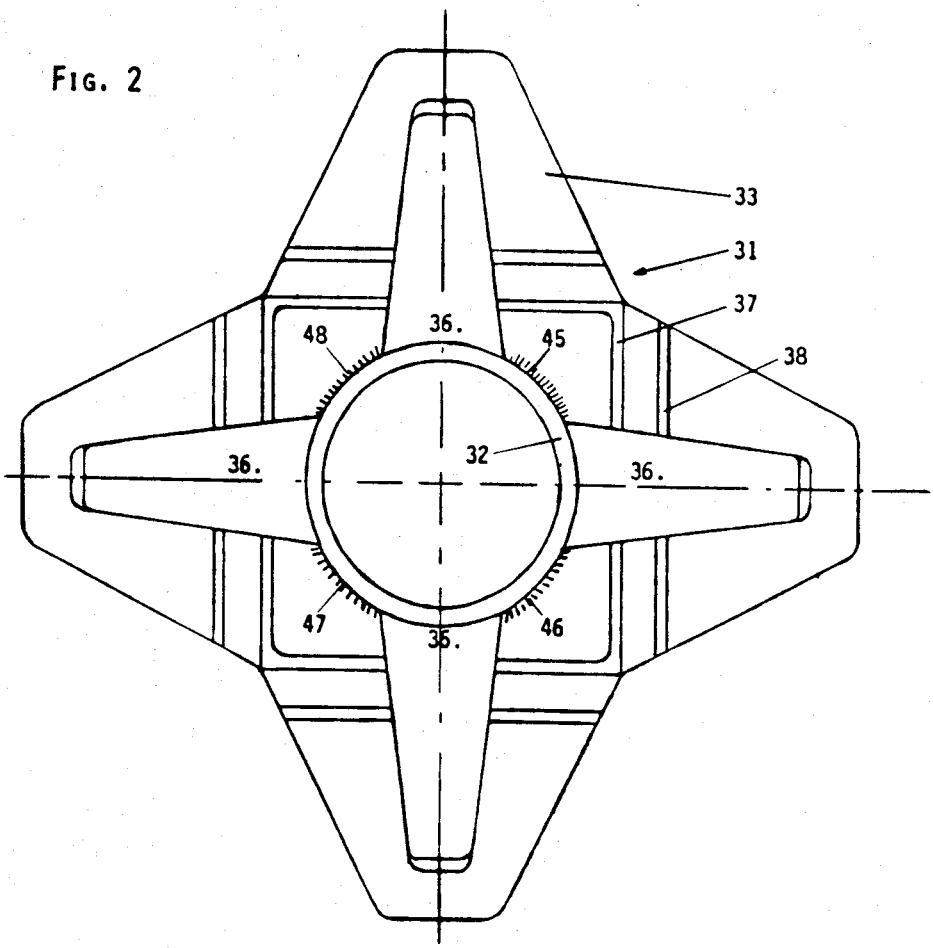
FIG. 2 is a top plan view of the annulus shown in FIG. 1.
Figure 3:
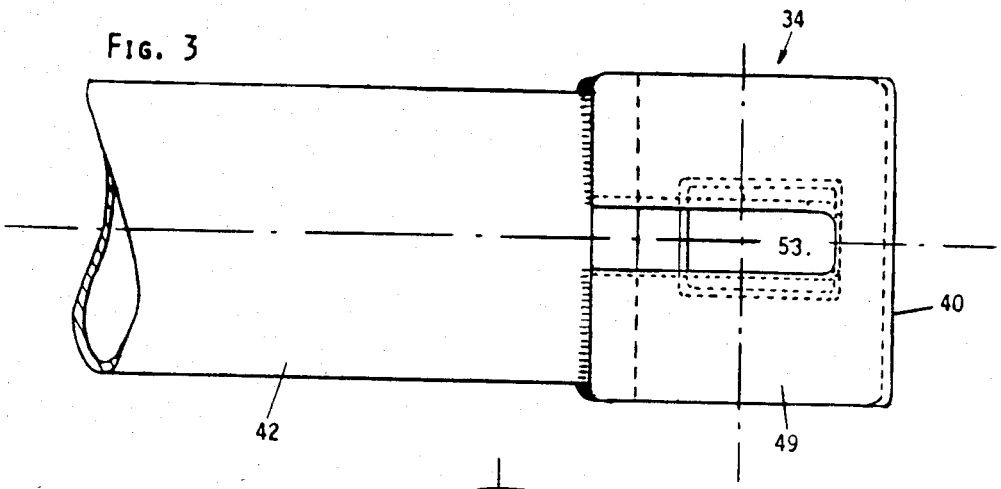
FIG. 3 is a top view of the bracket or end cap of a horizontal tubular element engageable on one of the arms of the annulus shown in FIGS. 1 and 2.
Figure 4:
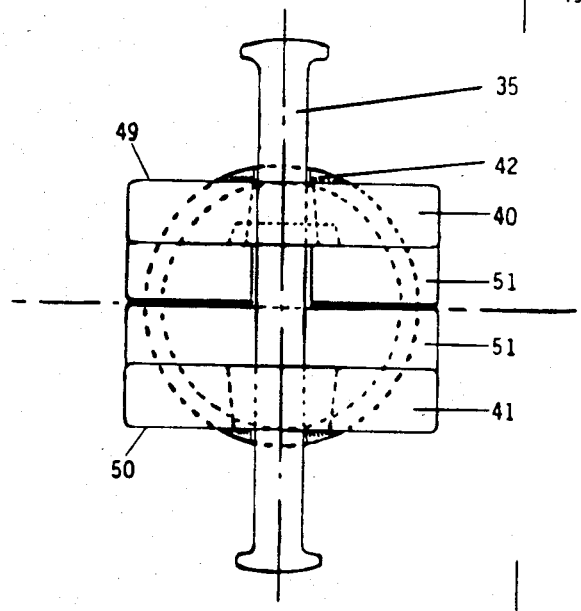
FIG. 4 is an end view of the bracket shown in FIG. 3.
Figure 5:
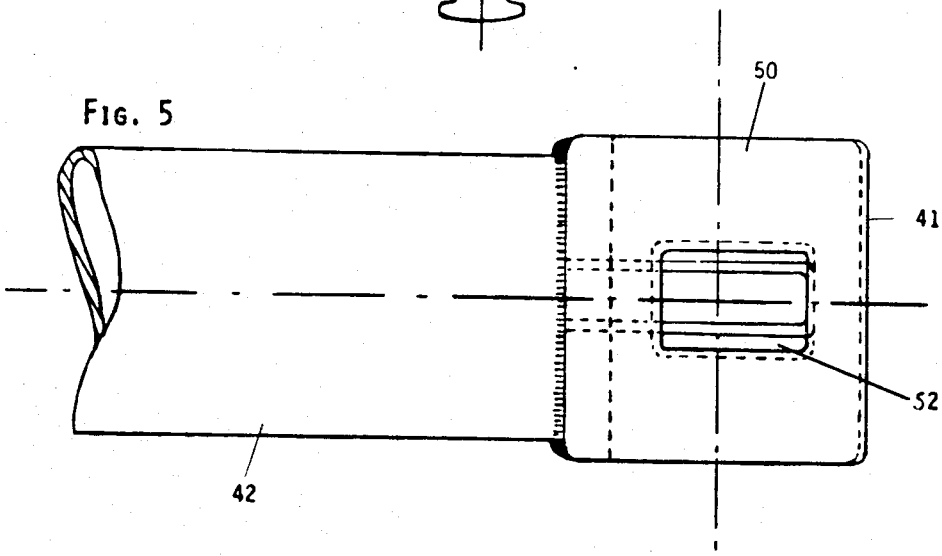
FIG. 5 is a bottom view of the bracket.
Figure 6:
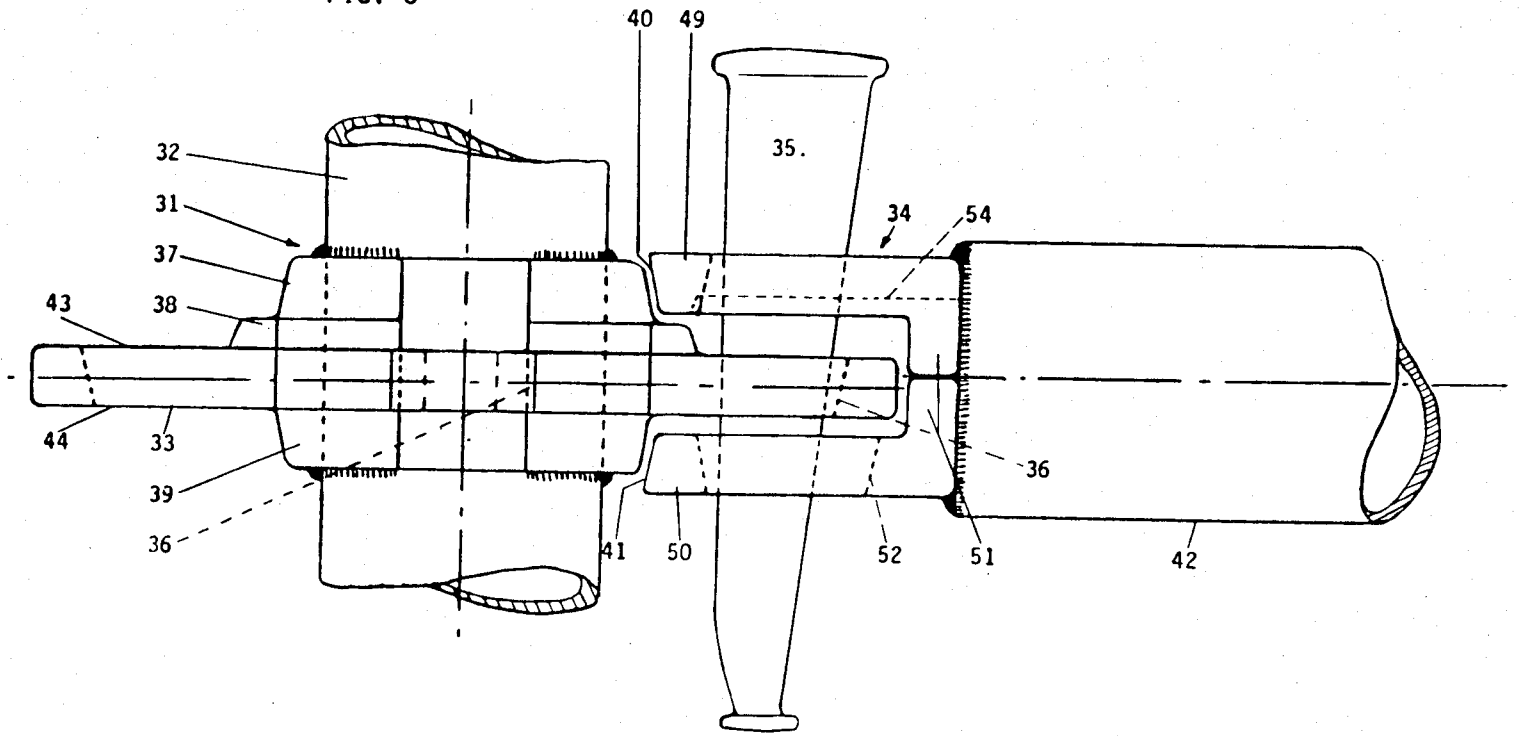
FIG. 6 is an elevational view of the assembly means.

With reference to the drawings and particularly to FIGS. 1 and 2, annulus 31 is slipped onto and fixed to vertical tubular element 32. Further annulus 31 is in the shape of a star with four arms 33 of which each in turn constitutes a radial arm engageable by bracket or cap 34 as shown in FIGS. 3, 4 and 5. The assembly is locked in place, as best shown in FIG. 6, by means of a flat key 35. Each arm of the annulus comprises a V-shaped radial clearance or aperture 36 terminating at its flared portion on the outside wall of tube 32. Each arm 33 further comprises, on either side of clearance or aperture 36, lateral bosses 37, 38, 39 in the form of steps and which receive the front ends 40, 41 of bracket 34 joined to the radial tubular element 42.

As best shown in FIG. 6, the support steps are provided on the upper and lower sides 43, 44 of each arm 33 and are of an adequate thickness and width to provide substantial stability to the corresponding ends 40, 41 of the bracket 34 and directional stability to the radial tubular element 42 both in a vertical and in a horizontal plane when key 35 is locked in place. Also annulus 31, as best shown in FIG. 2, is fixed to tubular vertical element 32 at several radial points along sections 45, 46, 47, 48 between radial clearances or apertures 36 of arms 33.

Moreover, as shown in particular in FIGS. 1 and 6, the support bosses or steps provided on each arm 33 are so arranged so that there are two steps 37,38 on the upper side 43 but only one step 39 on the lower side 44. Such an arrangement allows some play to the radial tubular element 42 in the vertical plane when it is set in place and almost automatically causes the captive key 35 to penetrate clearance or aperture 36 of arm 33 and the ensuing penetration of the lower clearance of bracket 34.

As shown in FIGS. 3–6, each bracket or cap 34 comprises two L-shaped elements 49, 50 fixed together at the respective edges of inner ends 51, the edges of the outer ends being designed to fit the shape of the corresponding step 37, 38 of arm 33 so as to rest firmly and stably on the steps. Lower element 50 comprises clearance 52 which is closed on its four sides and is penetrated by the tip of the key 35. Upper element 49 comprises clearance 53 extending into end 51 so as to permit introduction of key 35 of which the tip is laterally bulging and to hold it captive when bracket 34 is fastened to the end of radial tubular element 42. Also upper element 49 comprises lower cavity 54 corresponding to clearance 52 and which is of a width adequate to receive the bulge of the key tip and to retract it when the bracket is engaged on the selected arm 33 of annulus 31.

I claim:

1. Means for assembling tubular vertical and horizontal elements comprising annulus (31) fixed on a vertical tubular element (32), said annulus comprising multiple radial arms (33), at least one of said radial arms being engageable by a cap (34) joined to the end of a corresponding horizontal tubular element (42), an aperture (36) formed in said radial arm, step shaped bosses (37,38,39) formed on said radial arm adjacent said vertical tubular element and being adapted to receive the corresponding end of said cap, and said cap and said radial arm being interlocked by means of a key.

2. Means according to claim 1 wherein said annulus (31) is fixed to said vertical tubular element (32) at several radial points (45, 46, 47, 48).

3. Means according to claim 1 wherein said arm (33) is provided on its lower side (44) with a single boss (39) and on its upper side with two bosses (37, 38).

4. Means according to claim 1 wherein said cap (34) comprises two L-shaped elements (49, 50) and wherein said L-shaped elements are joined at their inner ends.

5. Means according to claim 4 wherein clearances are formed respectively in said L-shaped elements.

6. Means according to claim 5 wherein one of said clearances comprises a cavity (54) corresponding to a portion of said key.

7. Means for assembling tubular vertical and horizontal elements comprising annulus (31) fixed on a vertical tubular element (32), said annulus comprising multiple radial arms (33), at least one of said radial arms being engageable by a cap (34) joined to the end of a corresponding horizontal tubular element (42), an aperture (36) generally V-shaped in cross section formed in said radial arm, bosses (37, 38, 39) formed on said radial arm adjacent said vertical tubular element and being adapted to receive the corresponding end of said cap, said cap and said radial arm being interlocked by means of a key, said cap comprising two L-shaped elements (49,50), and said L-shaped elements being joined at their inner ends.

8. Means according to claim 7 wherein clearances are formed respectively in said L-shaped elements.

9. Means according to claim 8 wherein one of said clearances comprises a cavity (54) corresponding to a portion of said key.

10. Means according to claim 7 wherein said aperture is generally V-shaped.

* * * * *